US005280740A

United States Patent [19]

Ernst

[11] Patent Number: 5,280,740

[45] Date of Patent: * Jan. 25, 1994

[54] FLEXIBLE HEAD SOCKET WRENCH

[75] Inventor: Michael L. Ernst, Hamersville, Ohio

[73] Assignee: MAC Tools Inc., Washington C. H., Ohio

[ * ] Notice: The portion of the term of this patent subsequent to Feb. 25, 2009 has been disclaimed.

[21] Appl. No.: 551,217

[22] Filed: Jul. 11, 1990

[51] Int. Cl.[5] ..... B25B 23/16

[52] U.S. Cl. ..... 81/177.7; 81/73

[58] Field of Search ..... 81/177.7, 177.8, 73

[56] References Cited

U.S. PATENT DOCUMENTS 2,712,765 7/1955 Knight ..... 81/177.7 X 4,334,445 6/1982 Tibewell ..... 81/177.7

*Primary Examiner*—James G. Smith

*Attorney, Agent, or Firm*—Joseph G. Nauman; Eric J. Groen

[57] ABSTRACT

A socket wrench is shown having a socket driver head pinned to a clevis on a shaft. A sleeve is receivable over the shaft end and includes open ended slots pointing away from the clevis. The shaft includes a pin press fit within a cross bore on the shaft end, and the shaft and sleeve are axially slidable relative to each other; where in one position the pin engages one of the slots, and in another position, the shaft and sleeve spin freely of each other. A handle includes an internal bore which is profiled to compressively fit over the sleeve, and a chamber is defined between the sleeve and the end of the internal bore, to provide clearance for the axial movement of the shaft and sleeve.

20 Claims, 7 Drawing Sheets

FLEXIBLE HEAD SOCKET WRENCH

BACKGROUND OF THE INVENTION

1. Field of the Invention

The invention relates to an improved wrench having a flexible head socket wrench at one end, and a swivel handle at the opposite end.

DESCRIPTION OF THE PRIOR ART

It is often a requirement for mechanics, and other users, to loosen tightened threaded fasteners, e.g., threaded bolts or nuts, and then spin them off (or vice versa) with wrenches. Typically, a ratchet type socket wrench is used which applies a torque when turned in one sense, but rotates freely back to a starting position when turned in the opposite sense. While the ratchet wrench is quite handy in most situations, the ratchet only operates effectively when the resistance torque surpasses a certain amount. Said differently, when the bolt or nut is loosened to a certain point, or before tightened to a certain point, the ratchet does not operate, and rotation back and forth on the ratchet handle only rotates the fastener back and forth, rather than effectively engaging or disengaging it further.

Invariably, the fasteners are moved to a point where the resistance is too small for the ratchet to operate, yet when the ratchet and socket are removed, and the mechanic tries to remove the fastener by hand, the fastener once again tightens, if space constraints permit, and the ratchet must be used again. In such instances, mechanics often use extensions, and when the resistance becomes too low for the ratchet to operate, the ratchet only is removed or is locked, leaving the extension and the socket on the bolt head. The mechanic then grasps and torques the extension by hand, in an attempt to move the fastener rapidly. This attempt too, is sometimes futile, in that grasping the extension may be no better than grasping the fastener itself, when the fastener once again tightens back up, as the extension has no mechanical advantage when turned by hand. This operation is quite aggravating and time consuming for the mechanic.

U.S. Pat. No. 2,071,543 to Kress partially addresses the above mentioned problem. A socket extension has a shank 24 and an outer grip 26, where the outer grip is received concentrically over the shank 24. The shank includes at one end a square driver and at the opposite end a female square recess adapted to receive a square driver of a socket or similar wrench. The combination includes a pin 44 matable in an aperture 42 thereby allowing the outer grip member 26 to be locked relative to the shank 24 such that the wrench can be removed from the extension, and torque can be applied to the shank 24 directly by hand.

In the Kress device, when the socket wrench is removed, the torque applied to the square driver 30 is limited to the amount of torque which can be delivered to the handle by hand, as the Kress device has no mechanical advantage. It is inherently limited to situations where there is room for an extension. Furthermore, the detent ball 48 and the aperture 43 are open to the environment and can collect dirt and debris which could possibly affect the operation of the socket extension.

An object of the invention then is to design a tool which can operate in a mode as a wrench, and yet can also be used to operate in a mode to remove items such as bolts, and the like, when the resistance torque is too low for the operation of the ratchet, and to do so in most space constraining situations.

A further object of the invention is to provide a mechanical advantage to the tool when used in the mode for removing the item, when the resistance torque of the item is too low to operate the ratchet.

A further object of the invention is to provide the above mentioned tool where the structure is totally enclosed to prevent dirt and debris from affecting the operation of the tool.

Other objects and advantages of the invention will be apparent from the following description, the accompanying drawings, and the appended claims.

SUMMARY OF THE INVENTION

The above mentioned objects were accomplished by designing a tool comprising a shaft section having a first end, and a second end having a first locking shoulder. The tool further includes a tool engaging head including a driver, a secondary moment arm and a pivot section hinged to the first end of the shaft section. The shaft section is pivotal relative to the tool member, from a position where the shaft section is perpendicular to the working end and parallel to the moment arm, to a position where the shaft section is parallel to the working end and perpendicular to the moment arm. A handle means is concentrically receivable over the shaft section, where the handle means includes a second locking shoulder lockably matable with the first shoulder, and where the handle means is longitudinally movable relative to the shaft section, from a first position where the first and second locking shoulders are interengaging, to a second position where the handle means spins relative to the shaft.

In this manner, the tool can be placed into a configuration where the shaft is perpendicular to the tool member and used as a removal tool, such as a wrench. In this configuration, the moment arm for the wrench is the addition of the length of the shaft plus the length of the secondary moment arm. When the item loosens, the shaft is pivoted to a position where the shaft is perpendicular to the secondary moment arm and parallel to the tool member. The handle is then moved to disengage the first and second shoulders, and the vertical shaft is orbitally spun, the force applied to the handle being multiplied through the secondary moment arm.

DETAILED DESCRIPTION OF THE PREFERRED EMBODIMENT

Figure 1:
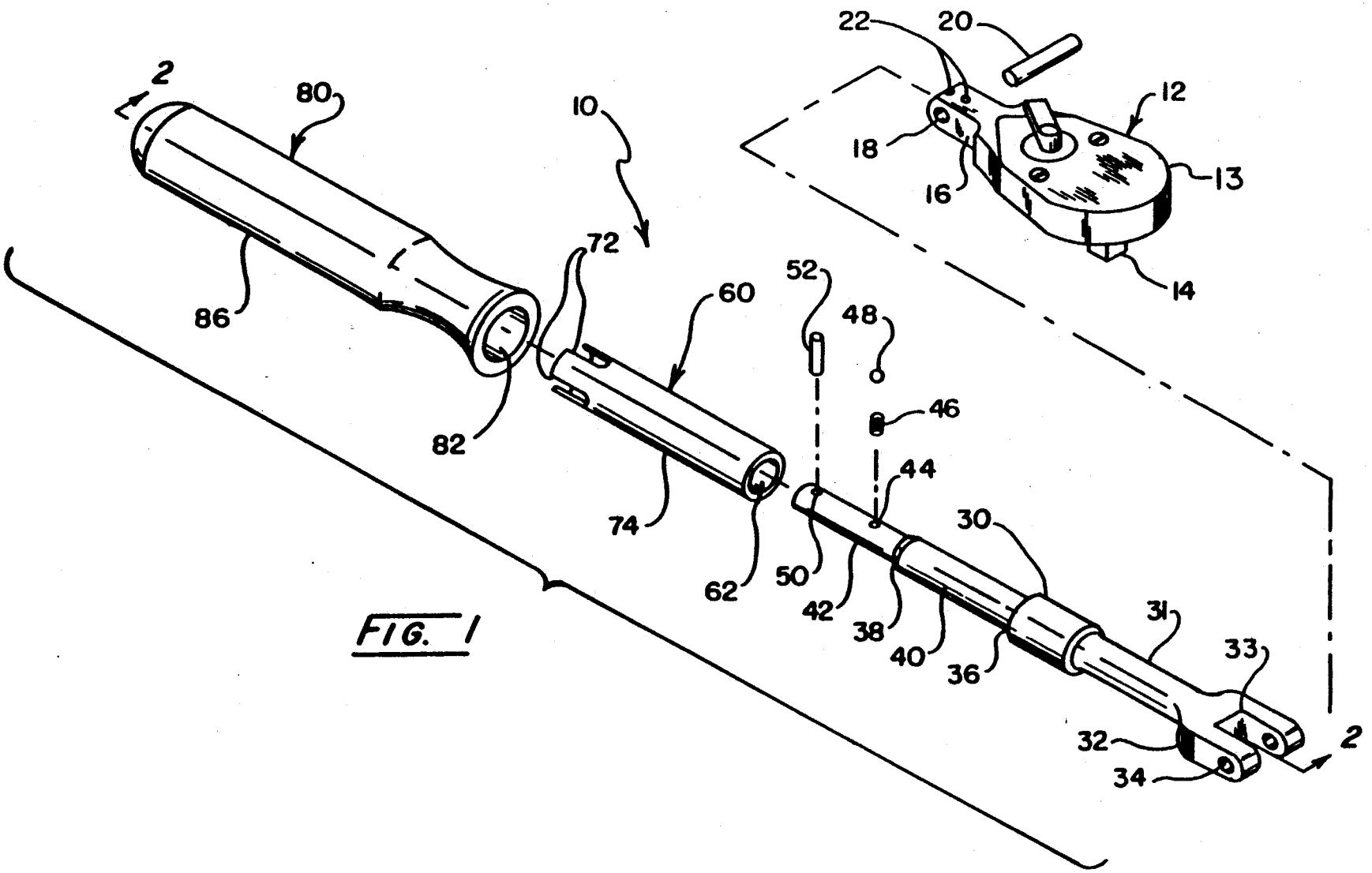
FIG. 1 is an exploded isometric view of the elements of the wrench of the invention.
Figure 2:
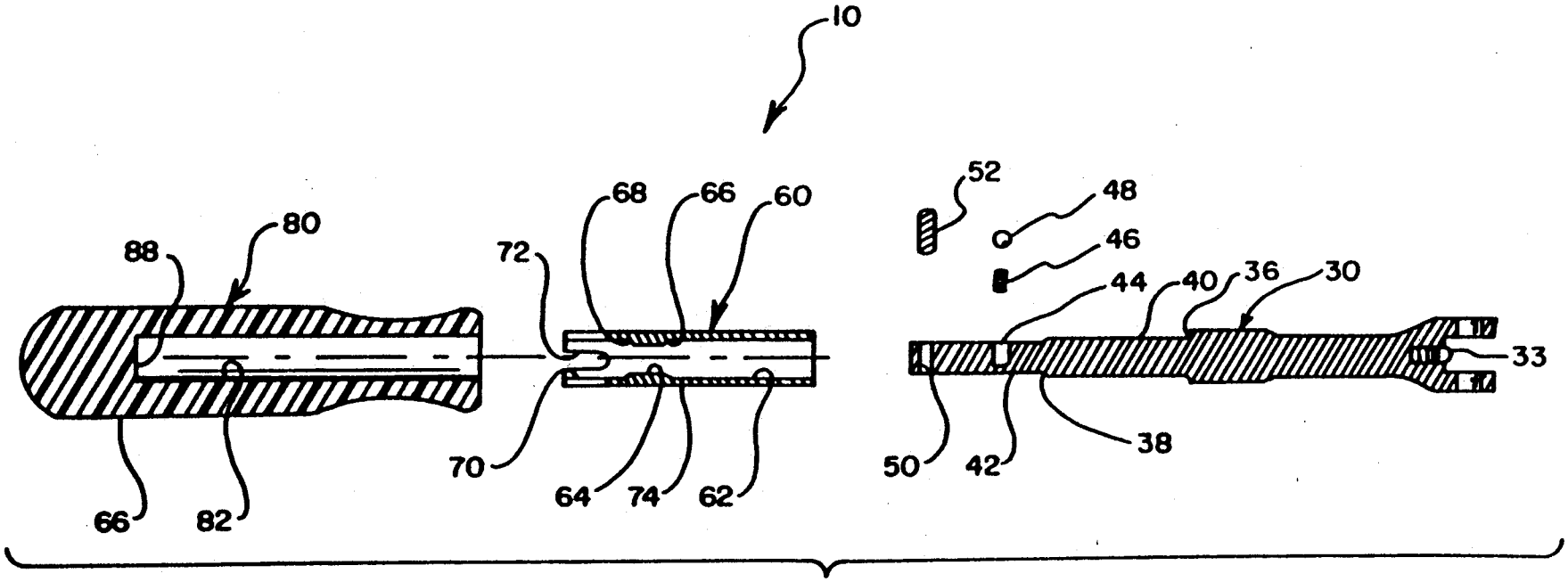
FIG. 2 is a cross-sectional view through lines 2—2 of FIG. 1.
Figure 3:
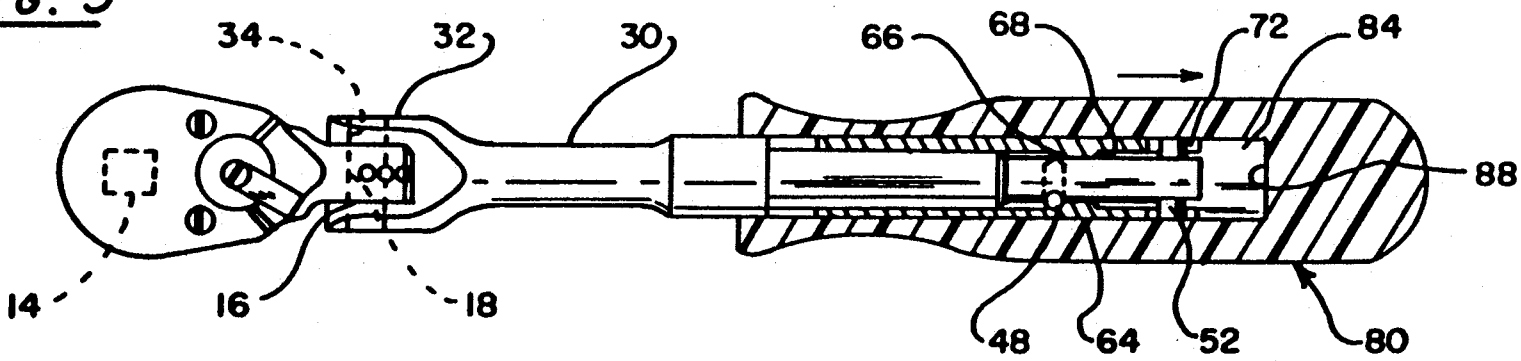
FIG. 3 is an upper plan view of the wrench partially in cross-section showing the handle extended relative to, and thereby locked to, the shaft.

With reference first to FIG. 1, the wrench of the subject invention is shown generally at 10 and comprises a socket driver head 12, a shaft 30, a sleeve 60, and a handle 80. With reference now to FIGS. 1-3, the individual items will be described in greater detail.

The socket driver head is shown generally at 12 and includes a driver body 13 housing a square driver 14 extending perpendicularly to a length of the body, and a shank 16 having an aperture 18 therethrough. The shank also has concave detent hemispheres therein, which will be described further herein. The socket driver head 12 is preferably of the ratchet type where torque can be applied to the square driver in one sense, and then the head can be rotated freely back to the original position, leaving the position of the square driver 14 unaffected.

Figure 5:
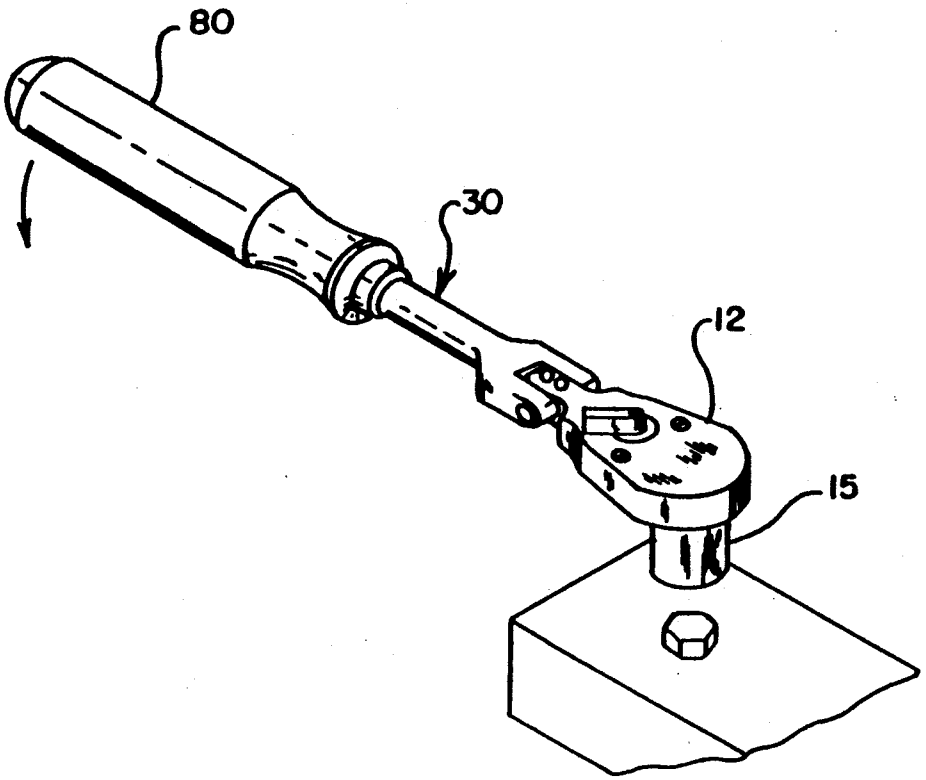
FIG. 5 is an isometric view showing the shaft of the wrench aligned with the ratchet head.

The shaft 30 includes a shaft body portion 31, having at one end a clevis 32 having an aperture 34 therethrough, where the apertures 34 and 18 are cooperatively profiled to receive a hinge pin 20 therethrough. The clevis also includes a spring-loaded detent ball 33 cooperable with the detents 22, to detent the driver head 12 and shaft into various pivot positions, for example, in the positions shown in FIGS. 5 and 6. The shaft 30 further comprises a rod section 40 extending from the second end of the shaft body portion 31, the intersection of the body portion 31 and the rod section 40 defining a shoulder 36. A spindle section 42 extends coaxially from the rod section 40, thereby defining a shoulder 38. The spindle section 42 includes a first cross-bore 44 to receive a spring 46 and a detent ball 48, therein. The spindle section 42 further includes a second cross-bore 50 profiled to receive a press fitted pin 52 therethrough.

With reference now to FIG. 2, the sleeve 60 includes a first bore 62 extending from one end and a second bore 70 extending inwardly from the opposite end. A narrowed neck portion 64 connects the first and second bores 62 and 70, the connection forming ramped shoulders 66 and 68. The sleeve 60 further includes four slots 72 extending into the end of the sleeve and which intersect the internal second bore 70.

The handle 80 includes an outer grip section 86 and an internal bore 82. The internal bore 82 is profiled to compressively receive the sleeve therein, such that rotation of the handle 80 will necessarily cause rotation of the sleeve. The internal bore 82 extends inwardly into the handle 80, to an end face 88.

To assemble the wrench 10, the socket driver head 12 is first assembled to the shaft, the pin 20 providing the interconnection between the socket driver head 12 and the clevis 32 of the shaft 30. The spring 46 and detent ball 48 are then inserted into the cross-bore 44 and the shaft 30 is inserted into the first bore 62 of the sleeve 60. The spindle section 42 and the neck portion 64, and the rod section 40 and the first bore 62 are cooperatively profiled for slidable bearing movement of the sleeve 60 relative to the shaft 30. The sleeve 60 is slid over the shaft 30, to a position where the cross bore 50 extends beyond the slotted end of the sleeve 60. The pin 52 is press fit into the cross bore 50 thereby locking the sleeve 60 to the shaft 30.

The assembled combination of the shaft 30 and the sleeve 60 are then inserted into the bore 82 of handle 80, the cooperation between the outer surface 74 of the sleeve 60 and the internal bore 82 of the handle 80 providing compressive retention of sleeve 60 within the handle 80. The sleeve 60 is inserted longitudinally into the handle 80 to a position shown in FIG. 3, where the slotted end of the sleeve is spaced from the internal end wall 88 of the handle, thereby defining a chamber 84 between the slotted end of the sleeve 60 and the end face 88 of the bore 80.

Figure 4:
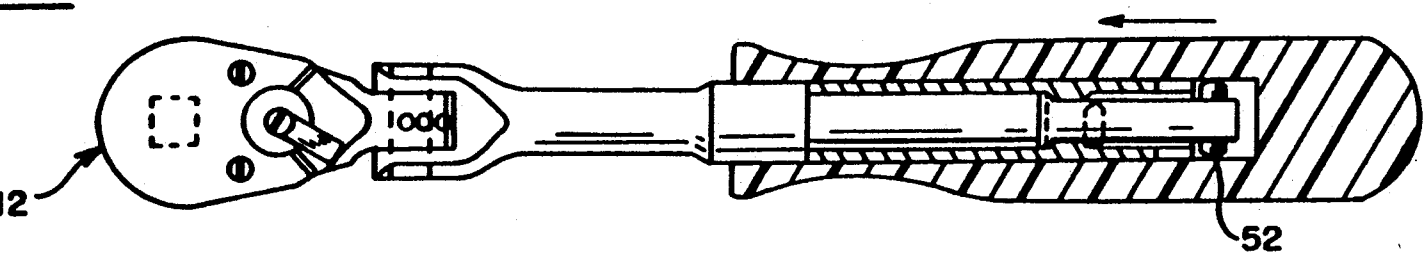
FIG. 4 is an upper plan view of the wrench partially in cross-section showing the handle retracted relative to, and thereby unlocked from, the shaft.

With the handle 80 fitted to the sleeve 60, the handle is movable relative to the shaft 30, between the positions shown in FIGS. 3 and 4. If the handle 80 is pulled outwardly to the retracted position shown in FIG. 3, the pin 52 and slot 72 engage to interlock the handle 80 to the shaft 30. The handle 80 is detented into this position, as the shoulder 66 of the narrowed neck portion abuts the spring loaded detent ball 48. If the handle 80 is moved towards the socket driver head 12, the narrowed neck portion 64 passes to the opposite side of the detent ball 48 to a position where the shoulder 68 abuts the detent ball 48. In this position, the pin 52 is released from the slot 72 and extends within the chamber 84, and the handle 80 can freely rotate relative to the shaft 30.

Advantageously, the wrench 10 described above can be used in one of several different modes to assist mechanics and the like in the workplace. First, if an item such as a bolt is to be removed, the wrench can be placed into the configuration shown in FIG. 5, where the shaft 30 is perpendicular to a socket 15, and the wrench 10 can be used in the conventional fashion.

Figure 6:
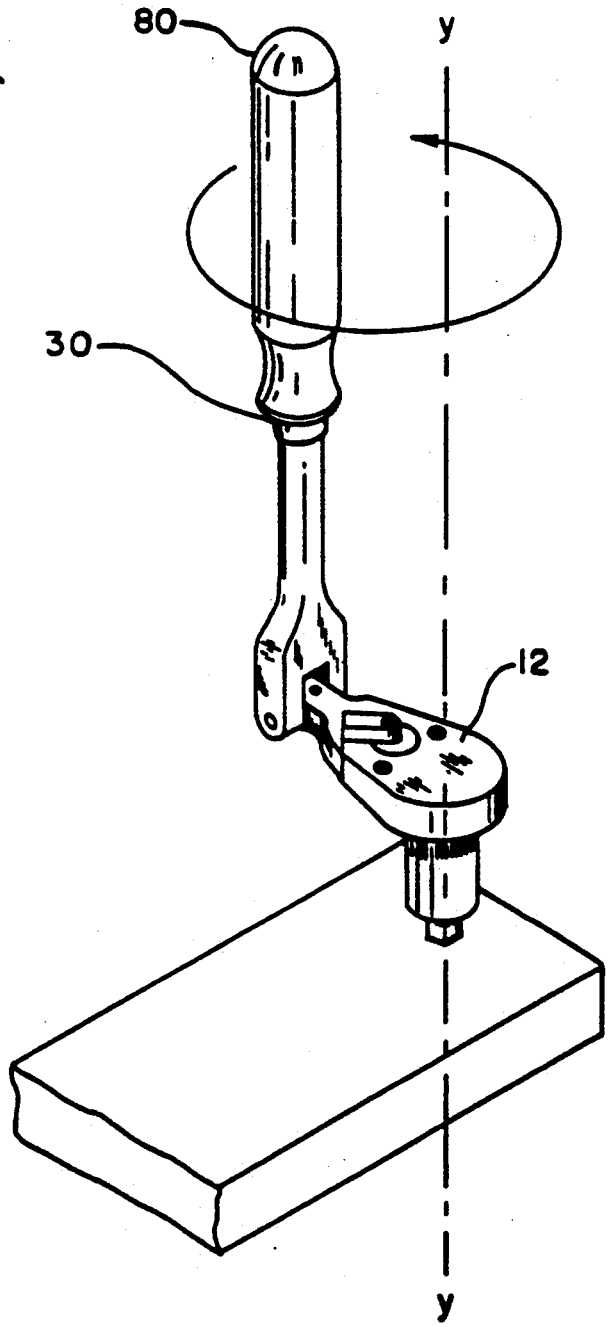
FIG. 6 is an isometric view showing the wrench handle and shaft pivoted to the position where the shaft is perpendicular to the ratchet head.

When the bolt is loosened to a position where the ratchet will not operate, the handle 80 and shaft 30 are pivoted about the clevis, to the position shown in FIG. 6, where the shaft is perpendicular to the socket driver head 12, and parallel to the axis of the socket 15. The handle 80 is then pushed down to unlock the pin 52 from the slot 72, and the shaft 30 and handle 80 are rotated in an orbital fashion, about the axis Y—Y. When used in this mode, the force applied to the handle 80 acts through a secondary moment arm, defined by a longitudinal distance between the clevis pivot 18 and the driver 14, to thereby provide a torque about axis Y—Y.

Figure 7:
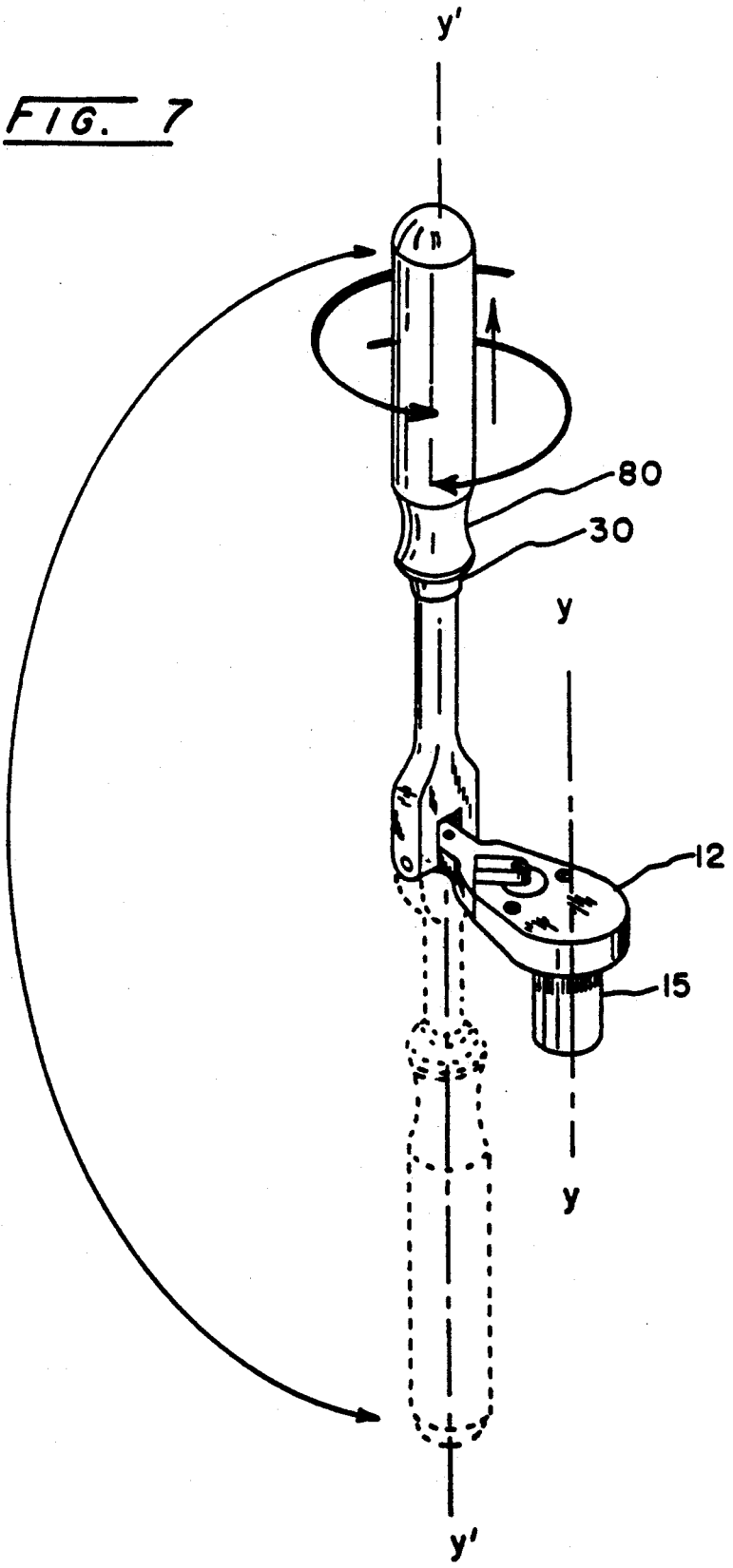
FIG. 7 is an isometric view showing two alternate positions for the shaft with the handle positioned for rotation during the application of torque to the ratchet drive.

Finally, if a bolt or similar item is not directly accessible from above, the handle 80 can be pulled up, locking the handle 80 to the shaft 30, as shown in FIG. 7. Torque is then applied directly to the handle 80, in either sense, and the torque about axis Y'—Y' will be transferred to axis Y—Y. Advantageously, the ratchet is useable in this configuration, preventing the user from repetitively readjusting the wrench for the insertion or removal of the bolt.

Figures 8, 9, 10:
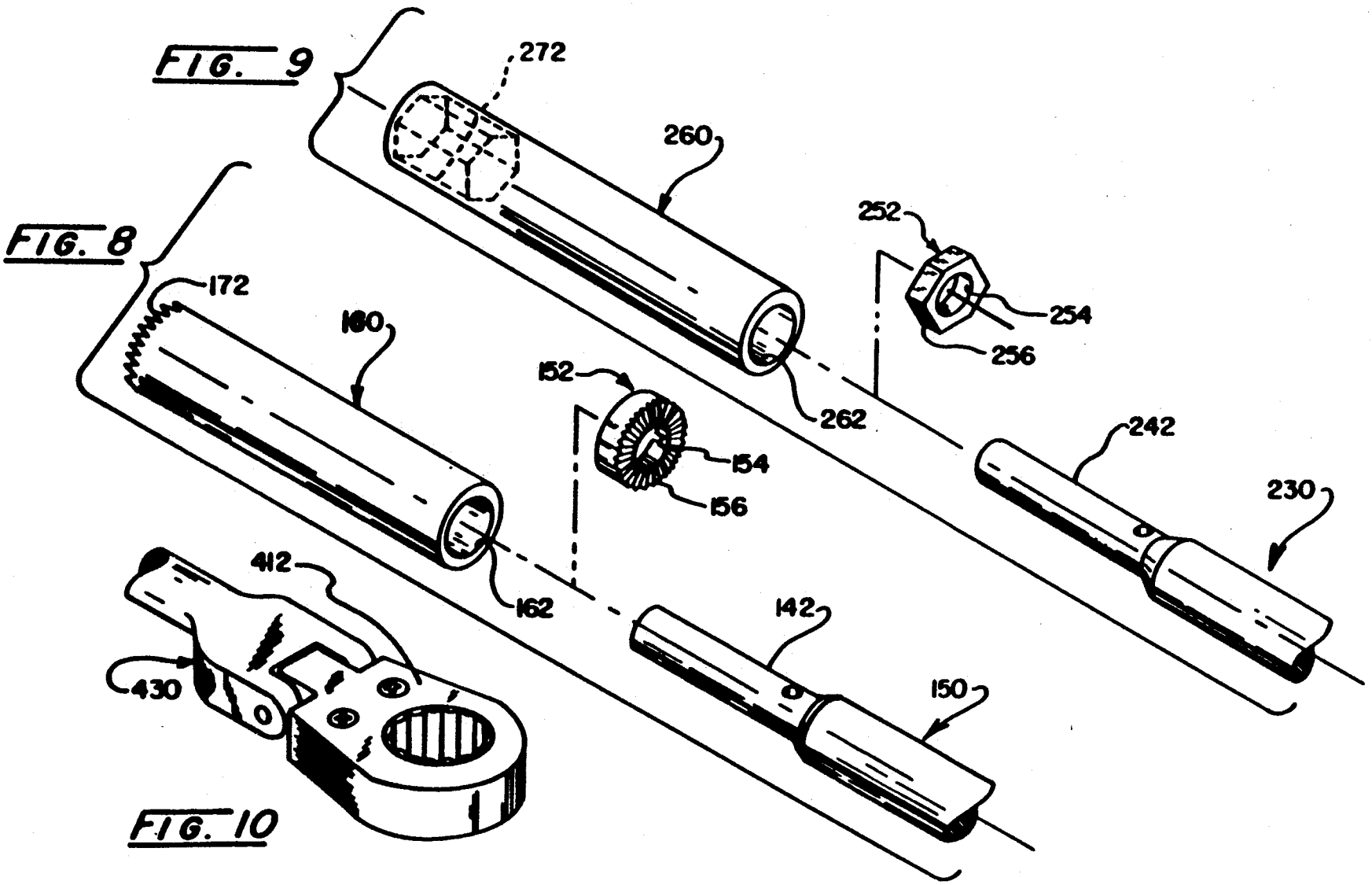
FIG. 8 is an isometric view of the shaft and the sleeve of an alternate embodiment.
FIG. 9 is an isometric view of the shaft and the sleeve of a further alternate embodiment.
FIG. 10 is a partial isometric view showing an alternate drive head.

While the tool is described as including a pin and slot for transmitting torque from the handle to the sleeve, other forms of torque transmission are also possible. For example, as shown in FIG. 8, an alternative tool includes a shaft 130 having a pinion section 142 adjacent to the end thereof. The shaft 130 is receivable in the sleeve 160, and is slidably cooperable with the sleeve bore 162 in a similar nature as the previous embodiment. After the shaft 130 is received in the sleeve 160, a gear such as 152 is press fit to the end of the pinion shaft 142, and the shaft is longitudinally slidable relative to the length of the sleeve, to bring the teeth 156 into and out of engagement with the teeth 172 on the sleeve.

Another alternative is shown in FIG. 9, where the shaft 230 can be received in a sleeve 260, with a hex driver 252 press fit to the pinion shaft 242 of the shaft 230. The shaft 230 is longitudinally slidable relative to the sleeve to bring the hex drive end portion 256 into and out of engagement with a hex driver 272 on the shaft 260.

The tool is also illustrated and described herein, for purposes of explanation, as a hinged ratchet head socket driver. However, it should be clear from the detailed explanation that many other forms of tool can utilize the handle arrangement provided by the invention. One such tool is shown in FIG. 10 as a ratcheting box wrench having a drive head 412 and a pivoting shaft 430. Other forms of tools are also possible, such as hinged box head wrenches, or even a drive tool, such as a screw driver or hex driver.

While the form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. A flexible head driving tool, comprising:

an elongate shaft having a shaft body portion having a hinge at a first end, a cylindrical rod section extending from a second end, and a spindle section extending coaxially from said rod section and having a diameter less than the diameter of said rod section;

a tool engaging head including a driver, said head being hinged to said first end of said shaft body portion;

a sleeve surrounding said rod section with an end portion of the spindle extending beyond the sleeve, the sleeve being slidable longitudinally of the rod section, the sleeve being slotted at an end adjacent to the spindle end portion;

a cross pin extending transversely outward from the spindle end portion, the slot and cross pin being cooperatively profiled such that said slot is adapted to receive at least one end of said pin when said sleeve is moved away from said tool engaging head; and an elongated handle grip having a cavity surrounding said sleeve and defining with the slotted end of said sleeve a chamber within which said pin can move out of engagement with said slot, when said sleeve is moved toward said tool engaging head to free said sleeve and handle grip for rotation around said sleeve.

2. The tool of claim 1, wherein the sleeve has a narrowed interior neck portion slidable along said spindle.

3. The tool of claim 2, wherein a detent on said spindle is located to pass through said interior neck portion of said sleeve and to extend outward of said spindle section when said sleeve is moved along said rod section to locate said neck portion on opposite sides of said detent when said sleeve is moved toward and away from said tool engaging head.

4. The tool of claim 1, wherein the distance between the driver and the hinge defines a secondary moment arm.

5. The tool of claim 4, wherein the handle grip and shaft are pivotal about the hinge from a position perpendicular to the driver, and parallel to the secondary moment arm, to a position parallel to the driver and perpendicular to the secondary moment arm.

6. A driving tool having a flexible head, comprising:

an elongate shaft having a shaft body portion having a hinge at a first end, a cylindrical rod section extending from a second end, and a spindle section extending coaxially from, and fixed to, said rod section and having a diameter less than the diameter of said rod section, and where the spindle section includes a detent means located on the rod section;

a tool engaging head including a driver, said head being hinged to said first end of said shaft body portion;

a sleeve surrounding said rod section, the sleeve including an internal narrowed neck portion profiled for sliding longitudinally along the spindle section to detented positions on opposite sides of the detent means; and means to lock said sleeve to said rod section, said locking means having locked and unlocked positions, wherein, when in said locked position, said sleeve being locked to said rod section, and when in said unlocked position, said sleeve being adapted to spin freely of aid rod section.

7. The tool of claim 6, wherein a handle is compressively fit to the sleeve.

8. The tool of claim 7, wherein the handle includes an internal longitudinal bore inserted over the sleeve.

9. The tool of claim 8, wherein the sleeve is spaced from an end face of the internal longitudinal bore defining an internal chamber therebetween.

10. The tool of claim 9, wherein the first shoulder is defined by a cross pin inserted within a cross bore of the shaft, and the second shoulder is defined by at least two slots at the inner end of the sleeve, the shaft being longitudinally slidable relative to the sleeve, from a position where the cross pin is locked within the slots, to a position where the cross pin spins freely within the chamber.

11. The tool of claim 6, wherein the distance between the driver of the tool engaging head and the hinge defines a secondary moment arm, and the shaft is pivotal to a position where the shaft is parallel to the driver and perpendicular to the secondary moment arm.

12. A tool, comprising:

a shaft section having a first and second end, a length of said shaft section defining a primary moment arm;

a tool engaging head including a tool body having a driver at one end of said body and positioned in and axis fixed perpendicular to said body, and a pivot section at an opposite end of said body hinged to said first end of said shaft section, a length between said axis and said pivot section defining a secondary moment arm, said shaft section being pivotal relative to said tool body, from a position where said shaft section is perpendicular to said driver and parallel to said secondary moment arm, to a position where said shaft section is parallel to said driver and perpendicular to said secondary moment arm;

a handle means being concentrically receivable over said shaft section, and rotatable relative thereto; and means to lock said handle means to said shaft section, said locking means having first and second positions, said first position allowing said handle means to spin freely of said shaft section, and said second position locking said handle means to said shaft section.

13. The tool of claim 12, wherein said driver is rotatable about said axis.

14. The tool of claim 13, wherein said tool engaging head is a ratchet driver head and said driver is a square socket drive.

15. The tool of claim 12, wherein said handle means comprises an outer handle portion having an inner bore, and an inner hollow sleeve fixedly retained within said inner bore, said inner hollow sleeve being concentrically receivable over said sleeve.

16. The tool of claim 15, wherein an inner end of said sleeve is spaced from an inner end of said inner bore of said handle to form a chamber therein.

17. The tool of claim 16, wherein said locking means comprises a cross pin inserted within a cross bore of said shaft, and at least two slots at said inner end of said sleeve.

18. The tool of claim 16, wherein said sleeve includes a first bore, a narrowed neck portion, and a second bore opening from said narrowed neck portion.

19. The tool of claim 18, wherein said shaft includes a first diameter shaft section which is receivable into said first bore, and a spindle section which is journalled on said narrowed neck portion, said cross pin being inserted at an end of said narrowed neck portion of said shaft, with said shaft being movable relative to said sleeve, from a position where said pin is locked within said slots to a position where said pin is beyond said slots to spin freely in said chamber.

20. The tool of claim 19, wherein said shaft includes a spring loaded detent ball inserted within said spindle section of said shaft, such that said spring loaded detent ball is engageable with shoulders formed on opposite ends of said narrowed neck portion within said sleeve to detent said shaft and sleeve in said respective first and second positions.

* * * * *